United States Patent [19]

Hansen

[11] Patent Number: 4,901,744

[45] Date of Patent: Feb. 20, 1990

[54] METAL PICKLING BATH TANK

[75] Inventor: Lars J. Hansen, West Alexander, Pa.

[73] Assignee: Hansen Engineering, Inc., West Alexander, Pa.

[21] Appl. No.: 231,781

[22] Filed: Aug. 12, 1988

[51] Int. Cl.[4] ..... B08B 3/10

[52] U.S. Cl. ..... 134/64 R; 134/122 R; 134/108; 134/201

[58] Field of Search ..... 134/84, 85, 86, 108, 134/90, 122 R, 201, 64 R; 220/400, 403, 470, 5 A; 266/275, 278, 280, 285, 286

[56] References Cited

U.S. PATENT DOCUMENTS

| | | | |
|---|---|---|---|
| 2,348,232 | 5/1944 | Tratumam et al. | 134/122 R X |
| 2,608,982 | 9/1952 | Zademaen et al. | 134/122 R |
| 2,676,599 | 4/1954 | McHenery | 134/122 R |
| 2,788,790 | 4/1957 | Jordan | 134/108 |
| 2,849,784 | 9/1958 | Adams | 68/207 X |
| 3,095,463 | 6/1963 | Chang et al. | 68/207 X |
| 4,453,875 | 6/1984 | Johnson et al. | 220/403 X |
| 4,604,157 | 8/1986 | Damirion et al. | 134/122 R X |
| 4,763,677 | 8/1988 | Miller | 134/122 R X |

*Primary Examiner*—Frankie L. Stinson
*Attorney, Agent, or Firm*—Eliot S. Gerber

[57] ABSTRACT

A system for the chemical cleaning of metal, for example, the acid pickling of steel, includes one or more tanks containing a corrosive liquid bath in which the liquid is flowed rapidly relative to the metal and held at a temperature in excess of 180° F. The tanks comprise an outer metal shell whose internal wall is protected by a layer of a rubber-like material. In one embodiment the rubber-like layer is protected from the hot corrosive liquid by panels of fiberglass reinforced plastic (FRP) which are overlapped in a shingle pattern. In another embodiment, an inner tub (tank) of FRP floats on a layer of water which is held between the inner FRP tub and the layer of rubber-like material which covers an outer metal shell.

9 Claims, 3 Drawing Sheets

METAL PICKLING BATH TANK

BACKGROUND OF THE INVENTION

1. Field of the Invention

The present invention relates to the apparatus for cleaning of sheet metal using a liquid bath, and more particularly to the tanks used for pickling sheet metal.

2. Description of the Related Art

Pickling is the process of removing oxides from steel by converting the oxides to soluble compounds using acids, alkaline solutions, or molten alkali salts. The steel, or other metal, is immersed in a liquid solution (bath) in a tank to remove the oxides, in the form of scales, which develop because of the hot rolling of steel or the changing temperature and moisture conditions from storage. Acid-pickling solutions for ferrous metals typically contain inhibited sulfuric ($H_2SO_4$), hydrochloric (HCl) or phosphorous acids. The parameters which may be controlled in the pickling operation include liquid temperature, concentration of the acid, time in the liquid bath, and turbulation. If any of these variables increase, the rate of oxide removal should also increase. Unfortunately, however, higher temperatures may generate corrosive fumes and rapidly corrode the pickling tanks.

The pickling of steel takes place in tanks, i.e., a large liquid-tight open-top tub. A conventional structure for such a tank uses an outer shell of mild steel which is lined with an inner shell or brick or concrete. The inner brick shell is lined with acid-resisting rubber or asphalt and has an inner heavy lining of vitrified acid-proof brick, or tiles set in cement. Consequently, tanks of almost any dimension can be built, particularly those with a rubber lining.

Natural and synthetic rubber are very useful in the construction of acid-resisting pickling tanks because tanks of brick, concrete, or steel can be lined with rubber on site. Natural rubber is the most widely used tank lining, due to its slow aging characteristics, mechanical strength, strong adhesion to steel surfaces, resistance to most pickling acids, ease of application, and adaptation to expanding surfaces. Rubber has been the best behaved material under medium temperatures. Its lifetime may be as much as ten years; however, above 180° F. (82° C.) rubber will rapidly deteriorate. A typical rubber lining may be a ⅛-inch or 3/16-inch thick sheet.

Plastic resins provide a variety of lining materials. However, most are used at temperatures less than 60° C. (140° F.). For example, glass fiber reinforced resins such as epoxy and furane are used as linings and are adhered to the rubber lining of a steel shell. Fiberglass reinforced plastic (FRP) is made of filaments or woven cloth of fiberglass embedded in a plastic resin base, such as a polyester or epoxy resin base. However, a lining of FRP may crack at temperatures greater than 180° F. because the FRP, which is attached to the metal tank, fatigues as the metal tank expands and contracts.

The known designs of linings of carbon brickwork or tile, set in cement over a rubber lining or FRP adhered to a rubber lining on a steel shell do not react in a satisfactory manner to the expanding and contracting surfaces of the metal shell.

U.S. Pat. No. 3,536,601 describes a method which attempts to lessen excessive acid attack during the pickling of iron and steel when the metals spend too much time in the acid bath. A DC voltage is applied between the metal and the acid bath to inhibit excessive acid attack.

U.S. Pat. No. 3,429,792 proposes a step-step method for descaling stainless steel surfaces. First, the steel is electrolytically descaled in an aqueous electrolyte and then pickled with an aqueous solution containing about 6.5–15% of ferric chloride and 5–10% of nitric acid.

SUMMARY OF THE INVENTION

The present invention presents two apparatuses for the pickling of steel at very high temperatures and high speed of operation. Generally, conventional pickling tanks, over 16 feet in length, could not function above 180° F. (82° C.). The unique structure of the tanks of the present invention enable the pickling to be accomplished at temperatures up to 220° F. (104° C.) and at relatively high speed.

Typical speeds of conventional push-pull lines reach 300 ft/min. At the higher temperatures of the present invention a rate of 1000 ft/min can be obtained with push-pull lines, and up to 2000 ft/min with straight (weld) lines each employing a tank 100 feet in length.

The first embodiment includes an outer metal tank shell, an intermediate rubber lining and an inner fiberglass FRP shingle lining. The rubber lining serves as a protective coating underneath the plastic resin shingles. For example, the shingles of styrene FRP will stick quite well to the rubber. The shingles are laid down overlapping one another, so that they may move relative to each other, to ensure flexibility as the metal tank expands and contracts. Because the FRP is in the form of discontinuous shingles, some slight leakage between them may occur. The rubber lining serves to protect the metal shell against such leakage from the shingles.

HCl and $H_2SO_4$ can withstand temperatures as high as 203° F. (95° C.) and HF and nitric can withstand temperatures up to 200° F. (93° C.). For example, in a pickling bath of 2%–15% $FeCl_2$ and 14%–1% HCl, or 1%–5% $FeCl_3$, relatively high temperatures, of between 180° F. (82° C.) and 220° F. (104° C.), and turbulence of the liquid will promote rapid and intense pickling. For example, the rate in a push-pull system may be 1000 ft/min and a rate of 2000 ft/min in a straight-line (weld) system. Higher iron content will inhibit HCl vapor emission (reduce vapor pressure) and will promote HCl retention. Higher temperatures may be achieved by increasing the iron (Fe) content and by using a sloping shallow tank bottom.

The second embodiment of the present invention consists of a steel tank shell, a rubber internal lining which covers the internal face of the steel tank shell, a water layer, and a continuous inner shell (tank or tub) of FRP. In this case, the inner FRP tub floats on the water, i.e., it may move relative to the outer metal tank. The FRP tub will not crack when the metal shell expands or shrinks. The rubber serves as a back-up protective layer in case tiny cracks form in the FRP inner shell.

A layer of support blocks, preferably plastic blocks, is positioned between the FRP tub (inner shell) and the rubber-lined metal outer shell to prevent contact between the two shells, permit relative movement between the two shells, permit expansion and contraction of the inner FRP tub, and permit flow of the water layer between the blocks. Preferably the water layer, which is either flowing or stagnant, is monitored for its acidity by a pH or conductivity meter. If the FRP tub (inner shell) should develop a leak, acid would flow from the FRP tube into the water layer and cause the water layer to increase in acidity. Any such leaks are detected, consequently, by the pH or conductivity meter. Preferably the water of the water layer is pumped from the tanks and used in the rinse in order to conserve water. If acid is detected in the water layer, a solenoid operated valve, controlled by the acidity measurement meter, changes the flow of the water from the water layer and uses fresh (non-acid) water for the rinse. In either case, the rinse water is re-used in the scrubber to conserve water.

As an alternative to the plastic block separators, the inner FRP tub may be separated from the lined outer shell (tub) using a granular solid, preferably sand, or a plastic foam impervious to the acid within the tub. The outer shell may be lined with a less expensive lining, such as PVC (polyvinylchloride) or a vinyl coating. The plastic foam may be in the form of strips glued to the lining of the outer shell. A suitable separator, for example, of 2 inches in thickness and of plastic foam, provides insulation which permits a saving in the heating of the liquid in the tub, easier maintenance of higher acid temperatures up to 220° F., and use of less expensive coatings on the outer shell.

Rubber is very adhesive to steel, and can also expand and contract in conjunction with the steel shell without cracking. However, rubber cannot function at high temperatures (greater than 180° F.), as can the FRP shingles or FRP shell floating on water. If the FRP shell or shingles should leak, such leakage of the pickling acid liquor will be at a lower temperature, and without turbulence, so that the rubber will be able to shield the steel from such leakage.

The fiberglass FRP shingles can adapt to the expanding surface. Also, FRP in shingle form can survive under very high temperatures —200° F.–210° F. (93°–104° C.). Since rubber breaks down at about 180° F. (82° C.), the FRP shingles protect the rubber lining, even when the acid liquid is about 220° F. In the second embodiment, the FRP layer is an inner tank shell which floats on a water layer so it, too, can expand and contract independently of the steel tank.

Generally, the resistance of epoxy resin and rubber to HCl is about the same at 180° F. (82° C.) or below. The resistance of rubber decreases, however, as temperature increases beyond that point. The two embodiments in this invention use FRP which can maintain its composition under much higher temperatures of an acid bath. Thus, pickling can be achieved at a much higher rate.

OBJECTIVES AND FEATURES OF THE INVENTION

It is an objective of the present invention to provide a system for the chemical cleaning of metal in which a liquid chemical flows over the metal at an increased temperature, in excess of 180° F., so that the cleaning may be accomplished in less time.

It is a further objective of the present invention to provide such a system which may be operated at relatively higher rates of production, For example, in the case of pickling of sheet metal, a continuous line may be run at over 1500 feet per minute (ft/min) and preferably at 2000 ft/min.

It is a further objective of the present invention to provide such a system which may be retro-fitted to existing pickling line equipment, including existing pickling line tanks.

It is a further objective of the present invention to provide such a system which will protect the tanks which hold the liquid chemical against corrosion, although the chemicals would be highly corrosive to bare metal tanks and to rubber-lined metal tanks.

It is a feature of the present invention to provide a system for the chemical cleaning of metal. Generally the metal is a coil of sheet metal or wire. The system may be a continuous line, a push-pull system or a batch system. In all cases the system includes a tank in which the metal is cleaned by a liquid chemical, such as pickling acid, and means to introduce the liquid chemical into the tank and maintain the temperature of the liquid in excess of 180° F. The metal is moved within the tank so that the liquid chemical flows over the surface of the metal.

The tank comprises a metal outer shell having interior and exterior faces and a layer of rubber-like material, such as natural rubber, covering the interior face to protect the outer shell from corrosion by the chemical. In one embodiment, a protective layer of plastic resin panels are laid in an overlapping shingle formation to cover the rubber-like material layer. In another embodiment a plastic resin shell, preferably of a fiberglass reinforced plastic resin, is positioned within the rubber lining, and preferably a layer of water is maintained between the plastic shell and the rubber lining.

Shallow tanks are used in which the steel is submerged 2 inches–20 inches, preferably about 2 inches–3 inches, and the bottom walls (floor) of the tanks are sloping. The velocity of the liquid is rapid, preferably a ratio of 1:3 between flow of liquid to total tank gallons.

Although indirect heating of the acid liquid is preferred in the high iron content tanks, direct steam injection into the acid, or preferably acid mixed with the steam, will be beneficial to removing scale even faster.

BRIEF DESCRIPTION OF THE DRAWINGS

Other objectives and features of the present invention will be apparent from the following description, taken in conjunction with the accompanying drawings, which describe the inventor's presently known best mode of practicing the invention.

The components of the pickling process and tanks are shown in the accompanying drawings, in which.

DESCRIPTION OF THE PREFERRED EMBODIMENTS

Figure 1:
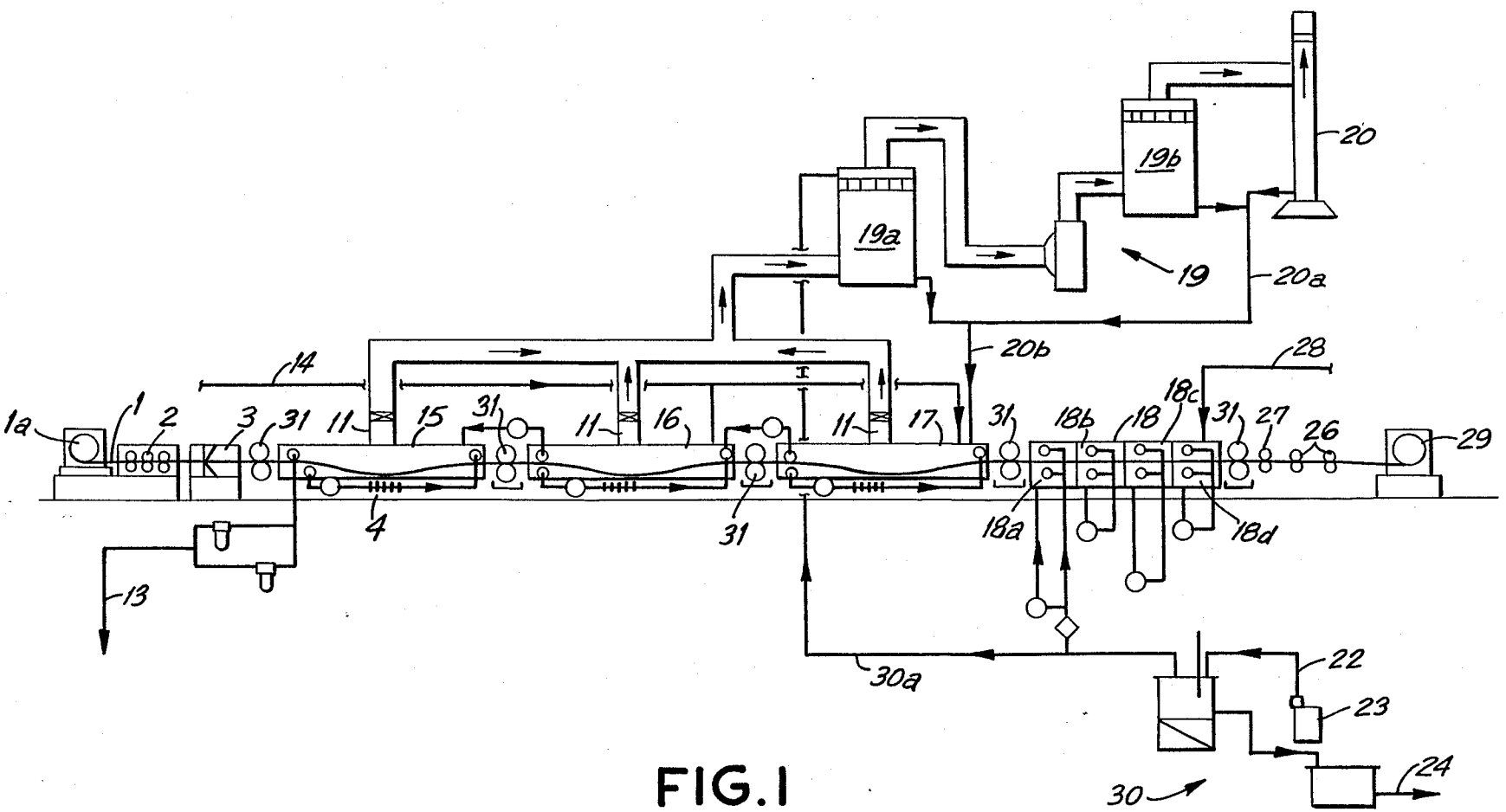
FIG. 1 is a schematic flow diagram of the push-pull pickling line of the present invention.

FIG. 1 is a diagram showing a push-pull pickling line. The uncoiler 1*a* at the start of the line unwinds the coil of rolled-up sheet steel. The sheet metal of the steel coils is typically 0.030–inch to 0.250–inch thick, up to 6 feet wide, weighing up to 80,000 lbs. The sheet metal is continuously fed into a flattener 2 which forms it into a flat sheet (plate). The flat sheet is sent to a cropping shear 3 which cuts its end in a straight line. The flattened steel sheet then moves between pinch roll drive 31 which progresses the sheet smoothly into the first tank 15. The term "push-pull" is used as the pinch rolls pull the sheet, at its input nip, and push the sheet at its output nip.

The first tank 15 is a preheater. Within this tank (tub) a liquid, preferably spent acid, is pumped directly out of the sump 15*a* at the end of the shallow tub (see FIG. 2), through a bypassing heat exchanger 4, to the opposite end 15*b* of the tank 15. The flow of the heating liquid over the metal sheet is counter-clockwise to the movement of the sheet 1 to achieve higher speeds. The strainer 7 in the recirculation pump loop 5 removes small scales and other debris. The tank 15, as the other tanks, has a sloping bottom wall 15*c* which slopes from end 15*b* to the sump end 15*a*.

The heat exchanger 4 is an internal heater which heats water or spent acid in the preheater tank 15. The overflow pump 6 protects against flood by pumping out excess liquid to spent acid storage and/or subsequent tanks for iron control. The flow control 8, an open pipe orifice, controls the liquid level 10. A vertically moving push roller 9, within the tank, determines the depth of the metal sheet's submersion into the spent acid. The tank is covered with cover 11*a* and a fume exhaust 11 leads the fumes (gas) into the scrubber 19. The preheater and acid tanks all have the same general equipment and configuration as the tank shown in FIG. 2, except that the preheater need not be covered.

As shown in FIG. 1, it is advantageous to generate acid 14 from a recovery plant 13 instead of using entirely fresh acid. Regenerated acid contains 14%–20% HCl and 0–3% $FeCl_3$ which promotes pickling. No inhibitors are necessary, and that acid solution gives an improved pickled surface.

Generally, four acid tanks, each between 40 and 100 feet long and up to 8 feet wide, are used. Longer lengths give greater continuous speeds, i.e., up to 2000 ft/min at 180° F. to 220° F.

Only three cascading tanks are used in the pickling line of FIG. 1. In the last tank 17 fresh acid is added, 9%–14% acid and 2% Fe. The second tank 16 uses between 5% and 10% acid and up to 10% Fe. The first tank 15 contains 5% acid and up to 15% Fe. The spent acid preheating tank is preferably 20 feet long. With acid regeneration, only two acid tanks are needed, and a preheated tank is not needed, because the acid is cleaner, i.e., from spent acid and grease, and the reduced need for low final acid.

Acid additions 14 are made to the last tank 17. Tank 17 has the highest acid concentration and cleanest acid. Hence, the cleanest final surface is obtained during rinsing. Acid can be added manually or automatically by means of hydrometer, titration, or conductivity meter. The tanks preferably have individually controlled acid additions to maintain the acid strength and desired iron concentration (by spent acid recirculation).

After the steel leaves the acid tanks, rubber coated squeeze rolls 31 remove excess liquid. The steel goes from the last acid tank 17 into a cascade rinse 18. Tank 18 has four sections, each of 5 feet in length, for a tank length of twenty feet. In tank 18 sprayers are used to flood the sheet metal. The sprayers are spaced 10 inches apart with $\frac{1}{8}$-inch to $\frac{1}{4}$-inch holes in 2-inch–3-inch diameter spray booms.

The first rinse 18*a* is 3 pH and up to 20 GPM recirculation and discharge of up to 20 GPM to scrubber system 19. Any excess rinse liquid from scrubber 19 is recycled through generator plant 13, or the excess liquid can be neutralized with caustic soda ash ($Na_2CO_3$), or lime from the caustic limestone crock 22, 23—a calcium carbonate base. Thus, a neutral salt is formed which is flowed into a sewer system 24.

The second rinse 18*b* is preferably at 3–4 pH. The third rinse 18*c* is preferably from 4–6 pH, and the last rinse 18*d* is preferably at 7–8 pH because local water 28 mixes into the last rinse. The rinses are with cold water 28, not above 120° F., to maintain good steel color.

The drying of the sheet metal occurs after its rinsing. The steel sheet goes through adjustable rubber-coated pinch rolls 31 to an air blast 27 which is cold or slightly heated. An oil coating 26 is applied to the sheet metal. A soluble oil with 20%–30% oil content is satisfactory. The oil is applied with a set of rubber-coated rolls on which the oil is sprayed. A sealer oil with rust inhibitor can also be used as primary or applied as secondary coat.

The scrubber system 19 uses acid liquid with low pH because such liquid scrubs better than fresh water with a higher pH. Rinse water from the rinse system 30 is sent to main scrubber 19 on line 30*a*. The liquid level and maximum percent acid (3% or HCl) is maintained by automatic valves controlled by conductivity sensors, and the level override is controlled to maintain a working balance. Used scrubber water is then led on line 20*b* to the last acid tank 17 (highest acid). Exhaust fumes are sucked from each of the tanks 15, 16 and 17 and sent to the scrubber 19 in which exhaust fans push the gases through recirculating towers 19*a* and 19*b*. The towers recirculate liquid created by condensing excess moisture from stack 20 which is sent to first scrubber tower 19*a* on a line 20*a*.

The fumes enter towers 19*a*, 19*b* at a tangent to increase turbulation and distribution efficiency in the tower. The last tower 19*b* will discharge into a stack 20. This scrubber system has been shown to produce less than $\frac{1}{2}$ ppm HCl emission on dry matter which is very well within the required environmental laws. All rinse water is used and returned to the pickle line on lines 20*a* and 20*b*.

None of the liquid tanks have progression rollers. Instead, pinch rolls 31, which are separately driven rollers, are positioned between the tanks and have a protective coating to stand any acid splashing that will occur. Pinch rolls can be driven with electric AC or DC or hydraulic drives for continuous weldlines. Such lines have granite slabs (not shown), between the tanks, which allow the strips to slide from tank to tank. Finally, the recoiler 29 at the end of the line will roll the pickled steel back up into a coil.

FIG. 1 describes the push-pull pickling line. For larger loads, the continuous (straight through) system may be used. This employs the same setup as FIG. 1, except that the tanks are longer and more acid tanks may be used. The uncoiled steel is welded to form a continuous sheet.

The batch system is used for smaller loads. The batch system, when used with the tanks of the present invention, utilizing higher temperatures, achieves more uniform pickling so the "zebra effect" and wire marks will be reduced or not occur. In the batch system the coil is uncoiled and then recoiled (rewrapped) with twisted alloy wires positioned between the individual layers (wraps) so that the liquid may flow between the layers. The coil is then dipped and spun (0–100 RPM) in a typical 12'×12'×10' tank. The tank has a steel shell, a rubber liner and an internal fiberglass reinforced plastic (FRP) lining in a shingle (overlap) pattern. Alternatively, a floating FRP inner shell (tub) may be used. Brick may be used on the bottom to avoid damage by the coil supports.

The first acid tank will contain 1–8% HCl and 5–15% Fe at a temperature of 160° F.–220° F. The coil is hooked to a rotating direct or indirect driven spindle that sits by means of a thrust bearing in the crane hook seat. The coil can either be moved up by crane or a monorail which will provide means for automation. The spinning is in the range of 5 to 100 RPM. The spinning will create a vortex in the center and will move acid rapidly down the center and up on the side. Preferably a cover is provided to prevent splashing and for fume control. An added benefit is to spin like a washing machine—clockwise for several seconds and then counterclockwise for a few more seconds to break up scale. The one directional spinning at slow speed, however, is more practical in terms of motor control. This first acid tank usually contains spent acid from the second tank which serves as oil or coating remover in case of repickling.

Next in this batch system, the coil, or wire bundle, is moved to the second acid tank which contains clean, fresh acid. The liquid in the second tank is kept at room temperature or slightly heated up to 180° F. and the coil or bundle is spun to obtain even and rapid pickling. The coil can be moved to the first rinse tank containing rinse liquid with 3–6 pH. After the rinse it is flushed with water, 7 pH, and moved to the second rinse, usually water which is heated and with pH between 6 and 8, or it may go directly to the protective coating tank. Preferably all the tanks are the same size. The spinning action will secure an excellent rinse and coating.

Figure 2:
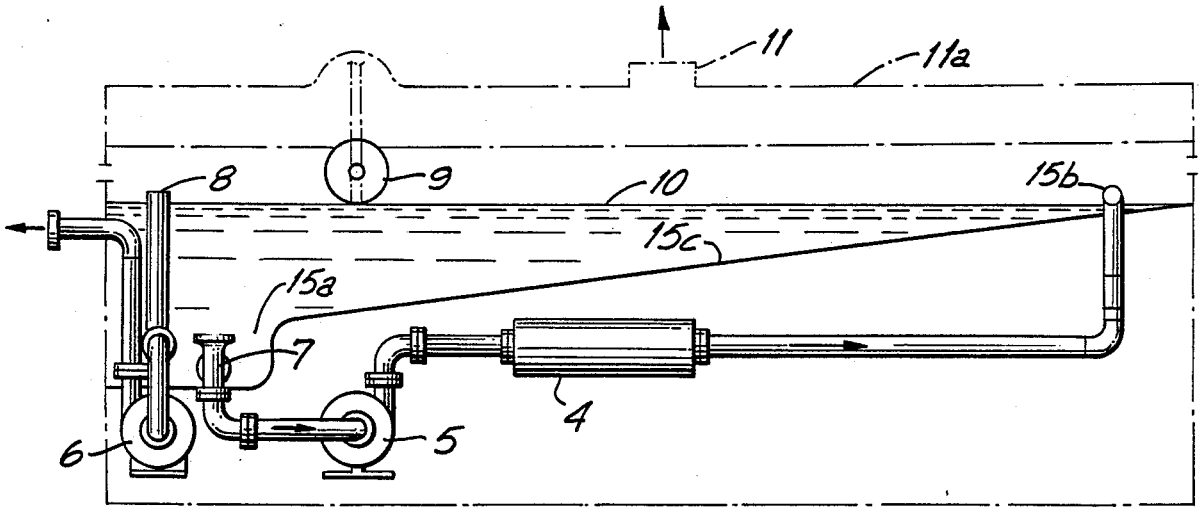
FIG. 2 is a side plan view of one of the tanks used in the pickling line of FIG. 1.
Figure 3:
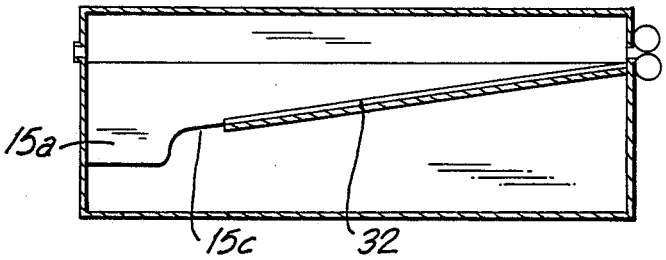
FIG. 3 is a side cross-sectional view of the same tank as in FIG. 2 but showing the rails which protect the tub linings.
Figure 4:
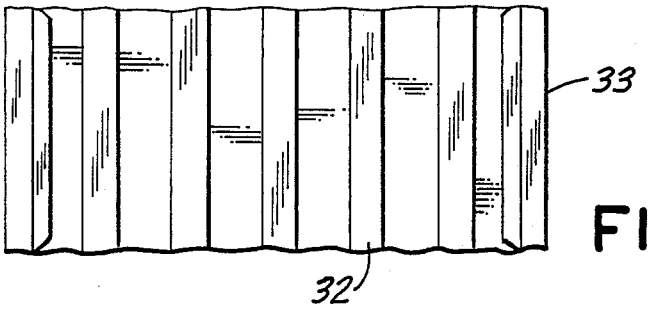
FIG. 4 is a partial top view of the tank of FIG. 2.
Figure 5:
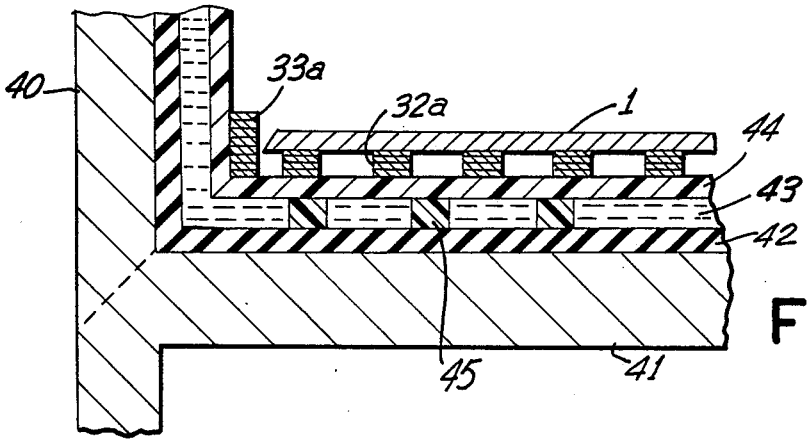
FIG. 5 is an enlarged cross-sectional end view of FIG. 3.

FIGS. 2 and 3 are side views of the tanks used in the continuous and push-pull methods. Rails are placed over the internal fiberglass layer so the sheet metal will not scratch the plastic resin. The rails are preferably of silicon carbide, above 40% silicon carbide impregnated plastic resin, granite or hard carbon. Alternatively to the rails, a top hard layer may be used, preferably of silicon carbide, ceramic tiles or $\frac{1}{8}$–$\frac{1}{4}$ thick resin impregnated with over 40% of silicon carbon (for use with HCl, $H_2SO_4$) or aluminas (for use with HF, $HnO_3$). A top view is seen in FIG. 4, in which bottom rails 32 are placed parallel to each other on the bottom wall of the tank, which is sloped as shown in FIG. 2. The sheet metal may or may not, depending on strip tension by pinch rolls or push-down roll, rest on these rails. To protect the sides from being scratched, two or more side rails 33 are positioned on the sidewalls of the tank. FIG. 5 shows an end cross-sectional view of the tank. As shown in FIG. 5, the metal outer shell has a sidewall 40 and a bottom wall 41, which slope relative to the horizontal. The walls 40, 41 are covered by a rubber-like sheet 42 which is adhered to the metal walls 40, 41. A layer of water 43 is trapped above the rubber-like sheet 42. A continuous inner shell 44 of fiberglass reinforced plastic FRP floats on the water 43. The rock side rail 33*a* and bottom rails 32*a* are fastened, by adhesive, to the FRP shell 44.

Figure 6:
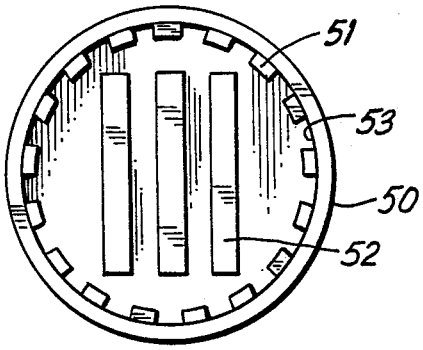
FIG. 6 is a top view of the batch method tank.

FIG. 6 shows the structure of one batch method tank 50 from a top view. The protective rails 51, in the form of rods or beams, are placed vertically on the internal wall 53 of the tank. The bottom wall of the tank 50, as seen in a top view in FIG. 6, shows the bottom rails 52 lying parallel to each other.

Figure 7:
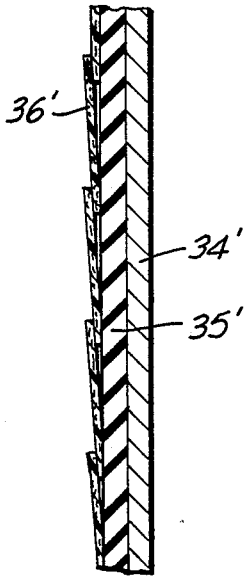
FIG. 7 is a side cross-sectional view of the lining of a rubber-FRP shingle tank.

FIG. 7 shows the FRP shingle lining of the acid tanks only. The cascade rinse tanks in FIG. 1 do need the respective linings because low acid is present. A steel tank 34' has a thick rubber lining 35 covering its internal wall. The rubber lining 35' lies between the FRP shingle layer 36' and the steel tank (outer shell) 34'.

As shown in FIG. 7, the individual shingle panels overlap each other in a shingle pattern as on a shingle roof. The shingle panels are of FRP and preferably in the range 8-in.–14-in. square (12-in. square preferred) and $\frac{1}{4}$–$\frac{3}{4}$ inch thick ($\frac{1}{2}$-inch-thick preferred).

Figure 8:
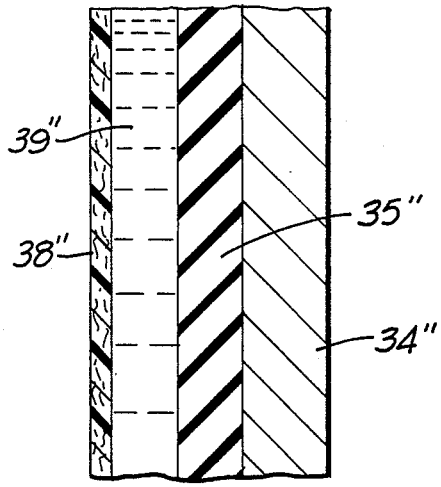
FIG 8 is a side cross-sectional view of the rubber-water-FRP lining of a tank.

FIG. 8 illustrates the rubber-water-FRP lining. A rubber layer 35'' coats the steel tank shell 34'. A layer of liquid (preferably water) lies between the rubber layer 35'' and the FRP inner shell 38''. The FRP shell 38'' floats on the liquid layer 39'' and is not adhered to the steel tank shell 34''. A layer of low friction blocks (separators) 45 is laid, in a checkerboard pattern, between the rubber layer 35'' and the FRP inner shell 38''. The blocks 45 are adhered to the rubber layer 35'' but not to the FRP inner shell 38''. Preferably the blocks 40 are polypropylene or other low friction plastic resin which retains its shape under pressure. The blocks 40 prevent the FRP inner shell from touching the rubber layer 35 and permit relative movement between the inner and outer shells. The inner shell may slide on the blocks as it expands and contracts. Preferably a similar layer of blocks is used in the tanks of the continuous and push-pull lines in which an inner FRP tub rests on a layer of water within an outer rubber lined metal shell.

What is claimed is:

1. A system for the chemical cleaning of metal including:

a tank in which the metal is cleaned by a liquid chemical;

means to introduce said liquid chemical into said tank and maintain the temperature of said liquid in excess of 180°;

means to move said metal within said tank so that the liquid chemical flows over the surface of said metal;

wherein said tank comprises a metal outer shell having interior and exterior faces and a plastic resin inner shell which fits within the outer shell, holds said liquid, is not adhered to said outer shell and which is free to contract and expand relative to said outer shell, and further including a layer of rubber-like material covering the inner face of the outer shell and adhered thereto and not adhered to said inner shell.

2. A system as in claim 1 and further including a layer of water between said inner shell and said rubber-like material.

3. A system as in claim 2 and further including a plurality of separators between said inner shell and said rubber-like material, said separators permitting the flow of said water between said separators.

4. A system as in claim 1 wherein said rubber-like material is a natural rubber.

5. A system for the chemical cleaning of metal including:

a tank in which the metal is cleaned by a liquid chemical;

means to introduce said liquid chemical into said tank and maintain the temperature of said liquid in excess of 180° F.;

means to move said metal within said tank so that the liquid chemical flows over the surface of said metal;

wherein said tank comprises an outer shell having interior and exterior faces and a plastic resin inner shell which fits within the outer shell, holds said liquid, is not adhered to said outer shell and which is free to contract and expand relative to said outer shell, and a layer of liquid between said inner shell and said outer shell and a plurality of separators between said inner shell and said outer shell, said separators permitting the flow of said liquid between separators.

6. A system as in claim 5 wherein said metal is steel and said liquid chemical is a pickling chemical selected from the group of hydrochloric acid and sulfuric acid and nitric acid.

7. A system as in claim 6 wherein said steel is an elongated strip in the form of a roll and said roll is immersed in said tank in coiled form for batch processing.

8. A system as in claim 5 for the continuous treatment of strip steel in which the steel is uncoiled from a coil prior to entering said tank and the system includes, within the tank, a plurality of rollers to progress the steep strip through the tank.

9. A system as in claim 5 wherein said plastic resin is selected from the group of resin impregnated fiberglass and resin impregnated graphite fibers.

* * * * *